US007717014B2

(12) United States Patent
Carstensen

(10) Patent No.: US 7,717,014 B2
(45) Date of Patent: May 18, 2010

(54) TORQUE DRIVE FOR MAKING OIL FIELD CONNECTIONS

(76) Inventor: Kenneth J. Carstensen, P.O. Box 8728, Houston, TX (US) 77249-8728

( * ) Notice: Subject to any disclaimer, the term of this patent is extended or adjusted under 35 U.S.C. 154(b) by 358 days.

(21) Appl. No.: 11/890,234

(22) Filed: Aug. 6, 2007

(65) Prior Publication Data

US 2009/0038789 A1 Feb. 12, 2009

(51) Int. Cl.
*B25B 21/00* (2006.01)
*B25B 13/50* (2006.01)
*B25B 23/151* (2006.01)

(52) U.S. Cl. ..... 81/57.18; 81/57.14

(58) Field of Classification Search ..... 81/57.13–57.15, 81/57.18; 166/77.51–77.53
See application file for complete search history.

(56) References Cited

U.S. PATENT DOCUMENTS 3,693,727 A * 9/1972 Bell ..... 173/177
4,266,444 A * 5/1981 Anderson et al. ..... 74/661
4,979,356 A * 12/1990 Vatne ..... 81/57.16
5,823,074 A * 10/1998 Ahlstone ..... 81/57.34
6,829,967 B1 * 12/2004 Kemp ..... 81/57.15
7,013,759 B1 * 3/2006 Childress, II ..... 81/57.34

* cited by examiner

*Primary Examiner*—David B Thomas
(74) *Attorney, Agent, or Firm*—Jones, Tullar & Cooper, P.C.; Raymond A. Bogucki

(57) ABSTRACT

A power tong system for precisely making up a connection between two elongated elements, such as sucker rods, into an operative string for petroleum well installations. High precision is attainable to secure the full advantages of prestressing the coupling by combinatorial use of both a rotary drive to achieve a first contact position and a linear drive to secure a precise final torsioning. The mechanism for achieving this may employ a peripherally driven drive ring coupling gears engaged to the drive ring periphery, a rotatably driven drive and a linear gear rack which are both engageable to the coupling gear.

20 Claims, 8 Drawing Sheets

TORQUE DRIVE FOR MAKING OIL FIELD CONNECTIONS

FIELD OF THE INVENTION

This invention related to power tongs for making oil field connections and more particularly to power tongs for sucker rods and tubing connections.

BACKGROUND OF THE INVENTION

Systems referred to as power tongs have been widely used for some time in oil field installations for making and breaking connections between end threaded products which are to be united into a string by couplings which join the products end to end. Such products include sucker rods which extend downhole within tubing or casing and provide drive power for pumping petroleum to the surface. Other strings are also made up using power tongs, and these include tubular products in the form of tubing and casing.

As the technology has developed, the threaded connection between the elements in the string has had to become more precise and stronger because of increasing demands placed on the string. As the strings have increased in length consistent with wells drilled to greater depth, they have also encountered higher pressures, and ever higher loads and forces. More secure connections are thus needed to enable the downhole equipment to be utilized for longer periods of time, with higher reliability.

Sucker rods have pin ends which are threaded without a taper, and reliance is placed on making a shoulder connection which is properly prestressed to withstand the forces that are to be encountered in cyclic pump operation over a long duration. Tubing and casing, on the other hand, utilize tapered threads, and are subject to both internal and external forces and combinations thereof. Also, the integrity of the connection between male and female threads is a consequence not only of the degree of engagement but of the dimensional tolerances that are permissible.

An improvement in sucker rods is evidenced by U.S. Pat. No. 6,942,254 and application Ser. No. 09/960,391 of Kenneth J. Carstensen which both disclose a connection in which the end faces of the pin ends of the sucker rods engage each other either directly or via an intermediate torque disk. The connection is made up to a first operative point at which the pin ends are under initial compression and the coupling is then further tensioned to a further precise degree. This arrangement unites the component parts of the sucker rod connection in a manner such that they withstand the varying forces encountered during the action of a reciprocal or rotary pump, and resist the development of microcracks and consequent fatigue failures.

The practical economic and throughput requirements at operating wells do not justify or permit the installation of expensive and complicated systems for instrumenting the measurement of torque or displacement values. It is much preferred to utilize a torque applicator, specifically a power tong system, to apply a precise amount of torsional force so that the connection is mechanically secure and repeatable. In this regard, the sucker rod configuration of the referenced Carstensen patents places a high premium on a capability for prestressing the sucker rod connection with a high degree of precision. Also, since the same power tong must also function in the break mode (disengagement) it should perform all the needed functions as they are required.

SUMMARY OF THE INVENTION

A system for coupling the threaded ends of oil field connections to be made up into a string utilizes alternative sources for turning a rotary element engaged to the elements to be coupled together. A first motive source is a rotary drive for spinning the element to an initial engagement state, then a second longitudinally driven element with a variable but predetermined hydraulic pressure limit applies the desired final precise torsional force. The force applied by the longitudinally driven element can be precisely measured by a sensor, so that the torque applied can be raised to a present value within accurate limits.

An improved power tong in accordance with the invention, more particularly, utilizes a combined dual function drive mechanism which is capable of operating the driven element, namely the sucker rod, tubing or casing in both a spinning mode and a precise torque application mode. As used for sucker rods, the wrench flat of the sucker rod is entered within a spinner mechanism and engaged by cam operated gripping mechanisms which are urged inwardly as a rotary drive is turned about the wrench flat. The rotary drive includes a hydraulic motor with internal step down gears turning a drive gear on a shaft adjacent the periphery of a large rotary cam gear with outer peripheral teeth. The drive gear is not coupled to the teeth on the ring drive directly but via idler gears on each side of it which engage the peripheral teeth. In an initial spinning mode, the motor turns the rotary ring drive which in turn drives the gripping mechanisms and the sucker rod. This continues until a shoulder on the sucker rod that is adjacent the wrench flat engages the end of the coupling sleeve in the sucker rod connection. Once this position is reached, the spinning is stopped, and a wholly different engagement mode is activated to complete precise torquing. A gear rack adjacent the idlers is shifted into engagement with the peripheral teeth of the idlers. Then a double acting hydraulic cylinder coupled to the gear rack moves it laterally until a selected and controlled limit is reached, by turning the ring drive and the engaged sucker rod until a precise rotational force level is established by an associated sensor. This prestresses the connection between the sucker rods, by virtue of the physical engagements of the sucker rods with the coupling sleeve, and provides superior realization of the benefits of the Carstensen sucker rod improvement referenced above. When a predetermined strain limit is reached, the drive cylinder is shut off and the gear rack is disengaged from the idler gears. The spinning action of the rotary ring drive is then reversed, and centrifugal force disengages the gripping heads from the wrench flat. The tongs can then be drawn away from the sucker rod via the passageway provided in the spinner section. Strain gage measurements show that the limit of torque that is applied to prestress the sucker rod connection is extremely accurate.

BRIEF DESCRIPTION OF THE DRAWINGS

A better understanding of the invention may be had by reference to the following description taken in conjunction with the accompanying drawings, in which.

DETAILED DESCRIPTION OF THE INVENTION

Figure 1:
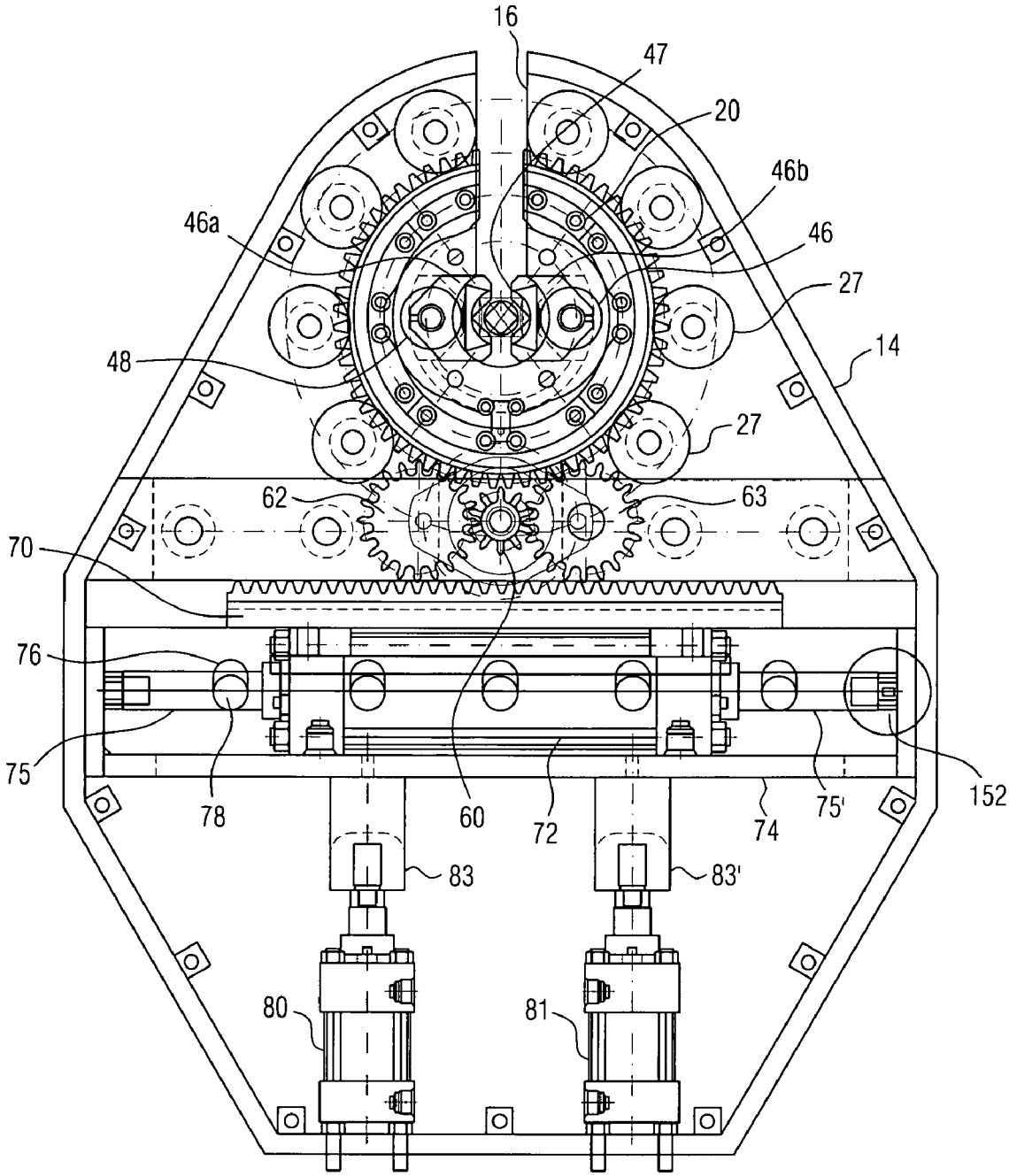
FIG. 1 is a cross-sectional plan view, of a power tong system in accordance with the invention.

Referring now to FIGS. 1-7, a power tong in accordance with the invention is shown as it is configured for sucker rod operation. The component parts are disposed within a rugged tong housing 10 comprising a full height rear section 12 joined to a reduced height front section 14. In the front section 14, a wrench flat access slot or passageway 16 provides a pathway for receiving the wrench flat portion of a sucker rod at a position which will be called the wrench flat axis. This axis is usually vertical, and the entry pathway therefore is usually horizontal. A rotary cam gear 20 in the form of a robust ring drive disk having peripheral teeth 22 and an interior cam surface is concentric with the wrench flat axis and positioned in the front section 14. Within the rotary cam gear 20, the peripheral teeth 22 are positioned at mid-height between upper and lower rings 24, 26 which also form part of the rotary gear. The rotary cam gear 20 has a circumferential opening which provides a radial slot complementary to that in the front section 14 of the housing and is aligned with it when engaging and disengaging to wrench flats. The rotary gear 20 nonetheless rotates about the central axis because it is peripherally retained within a set of spaced apart rollers 27 disposed about the cam gear periphery, and each having upper and lower rollers 27*a* and 27*b* (FIGS. 2 and 4) engaging the ring surfaces 24, 26 so as to hold the rotary cam gear in concentricity with the wrench flat axis as it is driven.

An interior surface 28 (FIG. 1) of the rotary gear 20 is configured to provide two opposing cam lobes 29, 29' facing the wrench flat axis. The peripheral rollers 27 are mounted between flat upper and lower carrier plates 40, 42 and the opposite faces of the drive disk portion of the rotary cam gear 20 are held relative to the carrier plates 40, 42 by aluminum bronze friction segments 44 (FIG. 4) which engage the rotary gear 20 to hold it in planar position transverse to the wrench flat axis.

Figure 2:
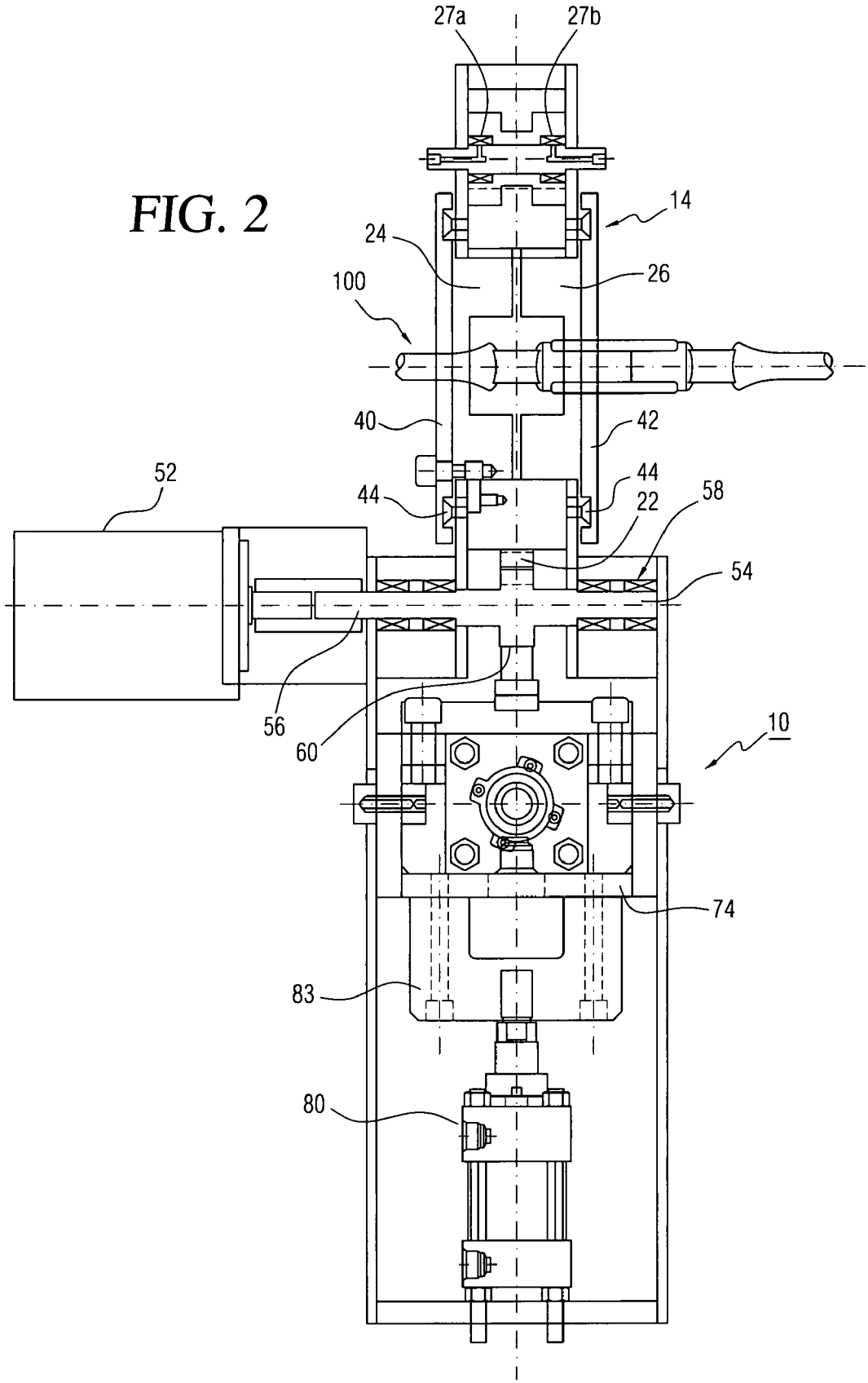
FIG. 2 is a side sectional view of the power tong system of FIG. 1.
Figure 3:
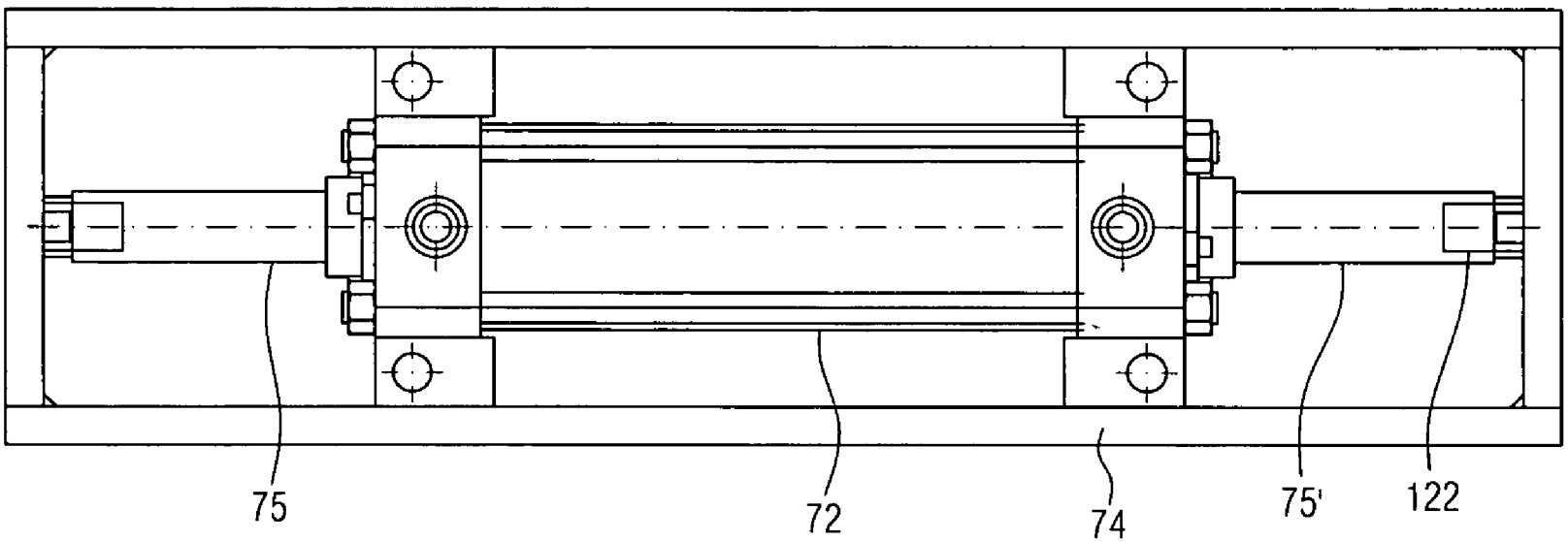
FIG. 3 is an end sectional view of the mechanism of FIGS. 1 and 2.
Figure 4:
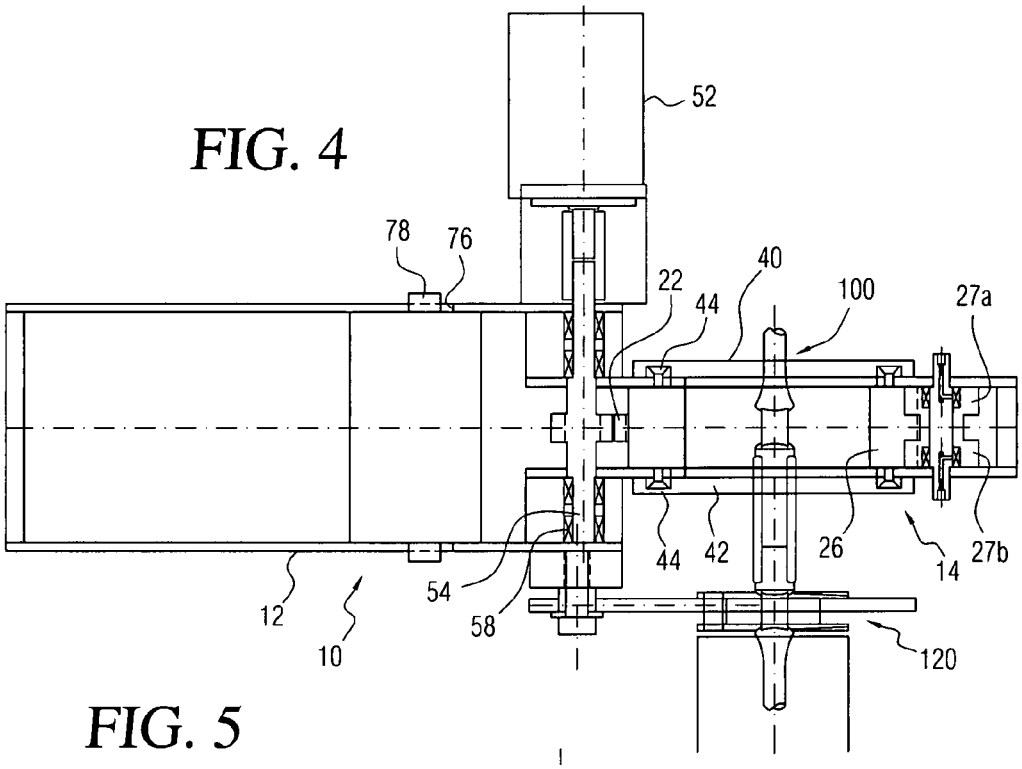
FIG. 4 is a side sectional view of the mechanism taken from a different angle, showing further details of the system.
Figure 5:
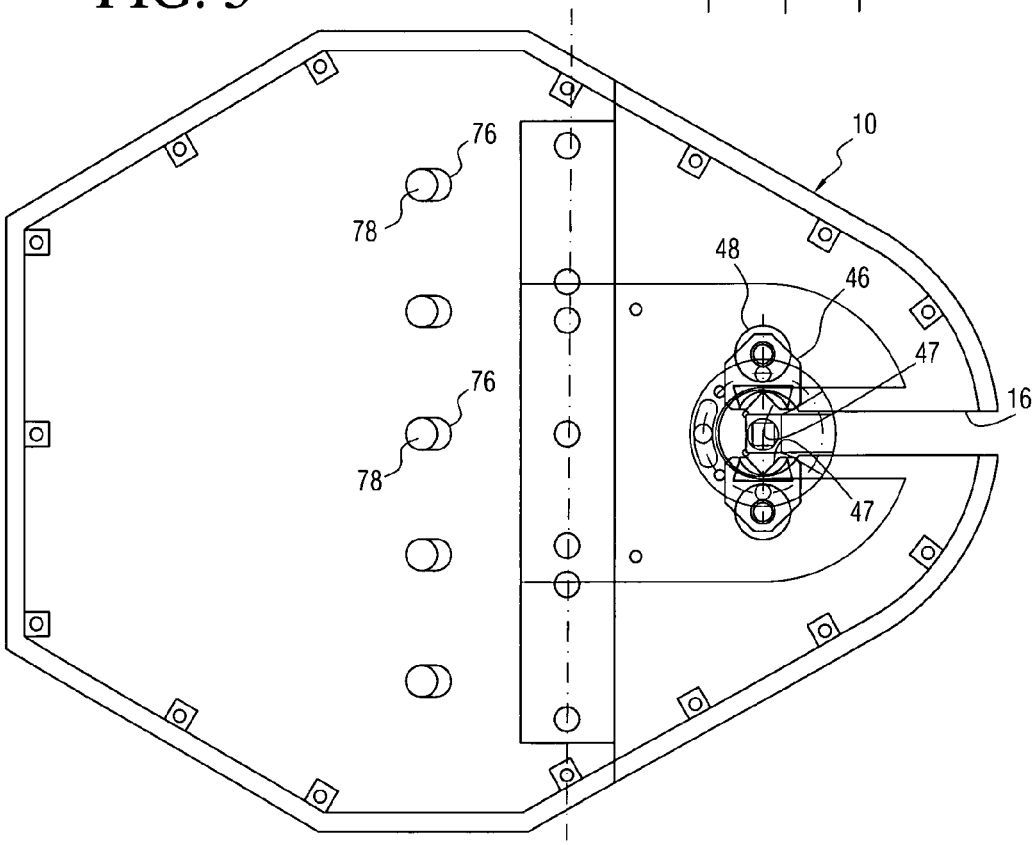
FIG. 5 is a plan view of the tong housing with the cover and internal parts removed.

A pair of gripping heads 46*a* and 46*b* are disposed on opposite sides of the wrench flat axis and, in the position of the rotary gear 20 shown in FIG. 2, are also approximately perpendicular to the entry slot 16. The gripping heads 46 each include inwardly facing teeth 47 (see FIG. 5) directed toward the wrench flat axis and cam follower rollers 48 in contact with the cam surface 28. When in contact with the interior surface of the rotary gear 20, the cam follower rollers 48 and the gripper head assemblies are of sufficient size and strength to withstand the substantial forces involved in making a connection and applying torque.

The drive in the rear section 12 operates in two modes. First, for spinning the sucker rod, it is coupled to a hydraulic motor 52 (FIGS. 4 and 6) directly engaged to a shaft 54 that is vertical with respect to the principal plane of the rotary cam gear 20. The shaft 54 is held between upper and lower bearings 56, 58 respectively and is coupled to a drive gear 60 (FIG. 1) positioned adjacent but spaced from the peripheral teeth 22 on the rotary cam gear 20. The hydraulic motor 52 may include internal step down gearing (not shown) to provide a desired combination of torque and rotational velocity. The shaft 54 mounted drive gear 60 engages separate adjacent idler gears 62, 63 (see FIG. 1) which mesh with the peripheral teeth 22 on the rotary cam gear 20. The idler gears 62, 63 rotate on short shafts (not shown) mounted in the top and bottom surfaces, respectively, of the rear section 12 of the housing.

Figure 6:
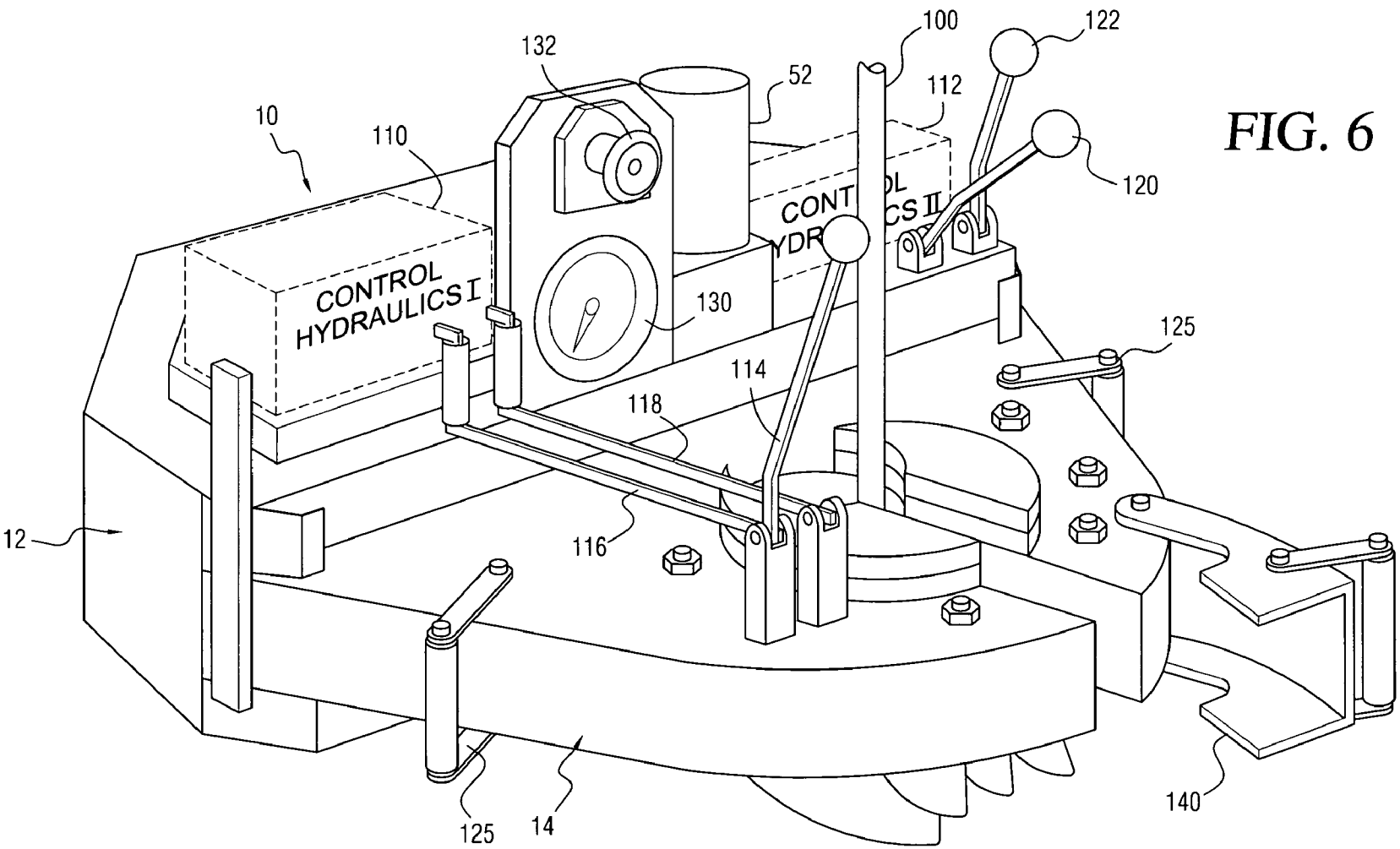
FIG. 6 is a combined perspective and block diagram view of the power tong system.
Figure 9:
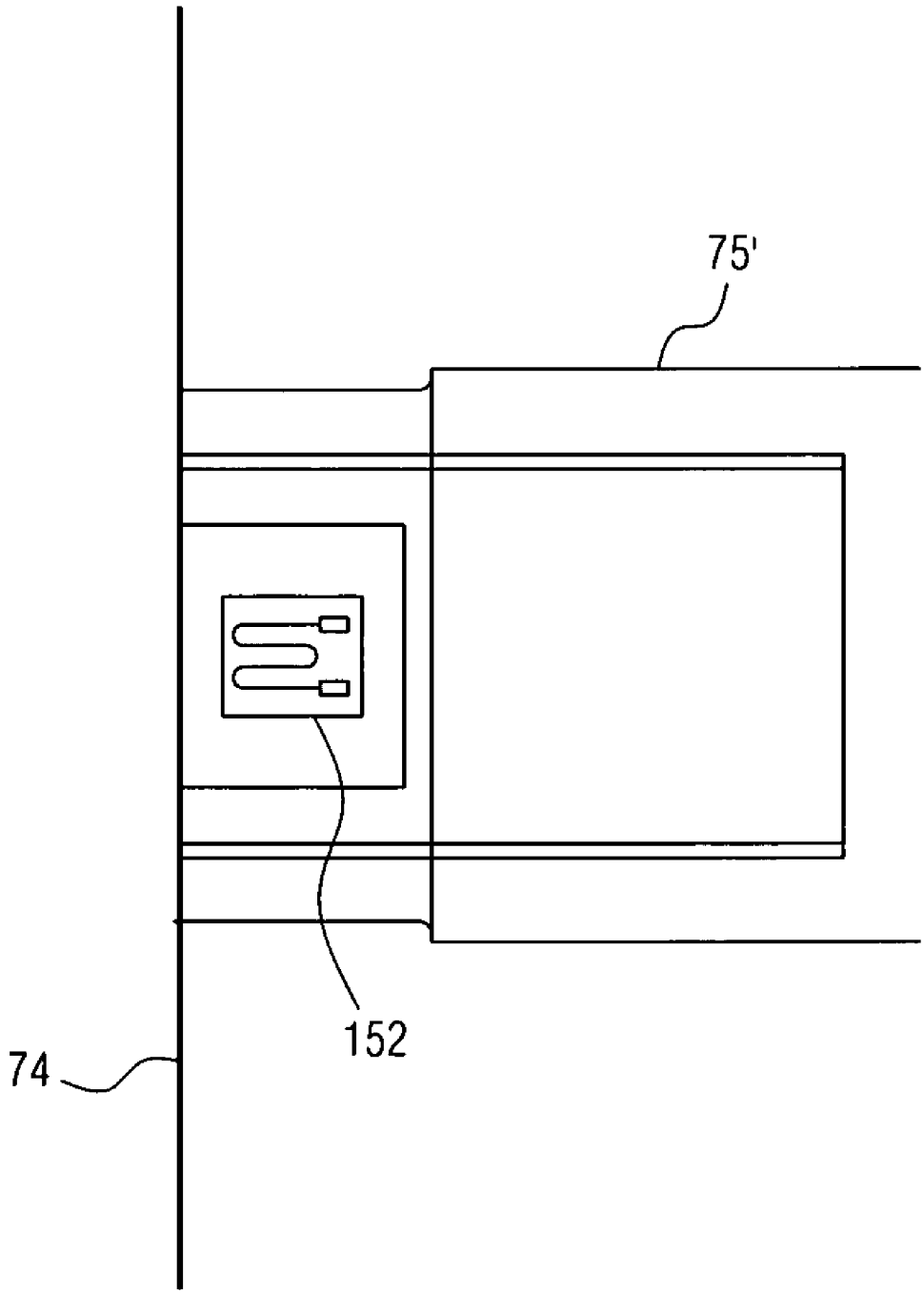
FIG. 9 is an enlarged fragmentary view of a stress sensor mounted in a hydraulic shaft used in the lateral drive.

In the second mode of operation, the rotary cam gear 20 receives motive power from a lateral gear rack drive 70 which is initially held at a space from the idler gears 62, 63, as seen in FIG. 1. The lateral gear rack drive 70 is attached to a double acting hydraulic cylinder 72 (FIG. 3) which has 10" stroke and is operated by a hydraulic control 122 (FIG. 6). The cylinder 72 is supported in a C frame 74 (FIGS. 1-3) fixed to the housing 10 at its ends, which abut the sidewalls of the rear section 12. Shafts 75, 75' coaxial with the cylinder 72 and mounted in the housing wall provide axial sliding support for the cylinder 72 and associated gear rack 70. A stress sensing transducer 152, as described in more detail below in conjunction with FIG. 9, is disposed in one of the shafts for providing a precise measurement of the torque applied.

The C frame 74 is movable in both radial directions, with respect to the central axis of the rotary gear 20, toward and away from the wrench flat axis, within a number of oval cam surfaces 76 (best seen in FIG. 5) in the top and bottom walls of the C frame 74, which receive cam followers 78 that are spaced apart in the transverse direction parallel to the cylinder 72. These cam mechanisms allow a range of radial motion of the C frame 74 toward and away from the rotary drive 20, so as the engage the lateral gear rack drive 70 with the idler gears 62, 63, and to release it from the same under hydraulic control.

The drive mechanism for radially shifting the lateral gear rack drive 70 for engaging and disengaging the gear rack 70 with the idler gears 62; 63, is provided by drive cylinders 80, 81 mounted in the rear section 12 against the back wall thereof, and positioned perpendicular to the gear rack axis. The drive cylinders 80, 81 engage a pair of drive brackets 82, 83' (FIGS. 1 and 2) which are coupled to the C frame 74. After the initial spinning of the rotary gear 20 brings the shoulder on the sucker rod pin end into contact with the end of the coupling, the connection is ready for prestressing. To this end, the operator engages an actuator (FIG. 6) which activates the control hydraulic controls 112, which include the sensor 152 to shut off the gear rack drive when a selected stress limit has been reached. This sensor may be a strain gage, a piezoelectric transducer, or any other of the many devices for providing the needed degree of precision.

Thus the power tongs in accordance with the invention utilize different modes of operation, so as to first engage the opposed gripping heads 47 (FIGS. 1 and 5) against the wrench flat on the sucker rod by action of the double lobed cam surface 29. Then the rotary gear 20 spins the sucker rod until the shoulder limit is reached and the drive stops, automatically or under operation control, as with the mechanisms shown in FIG. 6. Then the lateral gear rack drive 70 is engaged by using a first radial shifter for shifting it radially with respect to the central axis of the pear 20, to engage the idler gears 62, 63, then by using a second, reciprocating shifter for driving it tangentially with respect to the idler gears 62, 63 to provide a final increment of torque, but this time by lateral movement of the gear rack 70 so as to turn the sucker rod, until the predetermined limit is reached. The torque limit can be very precisely set, because it can be measured by modern strain gauge technology. The gear rack 70 can then be disengaged and the rotary drive reversed, this reversal causing the gripping heads to release by centrifugal force, so that the sucker rod can be removed and replaced with a new connection that is to be made up.

Figure 7:
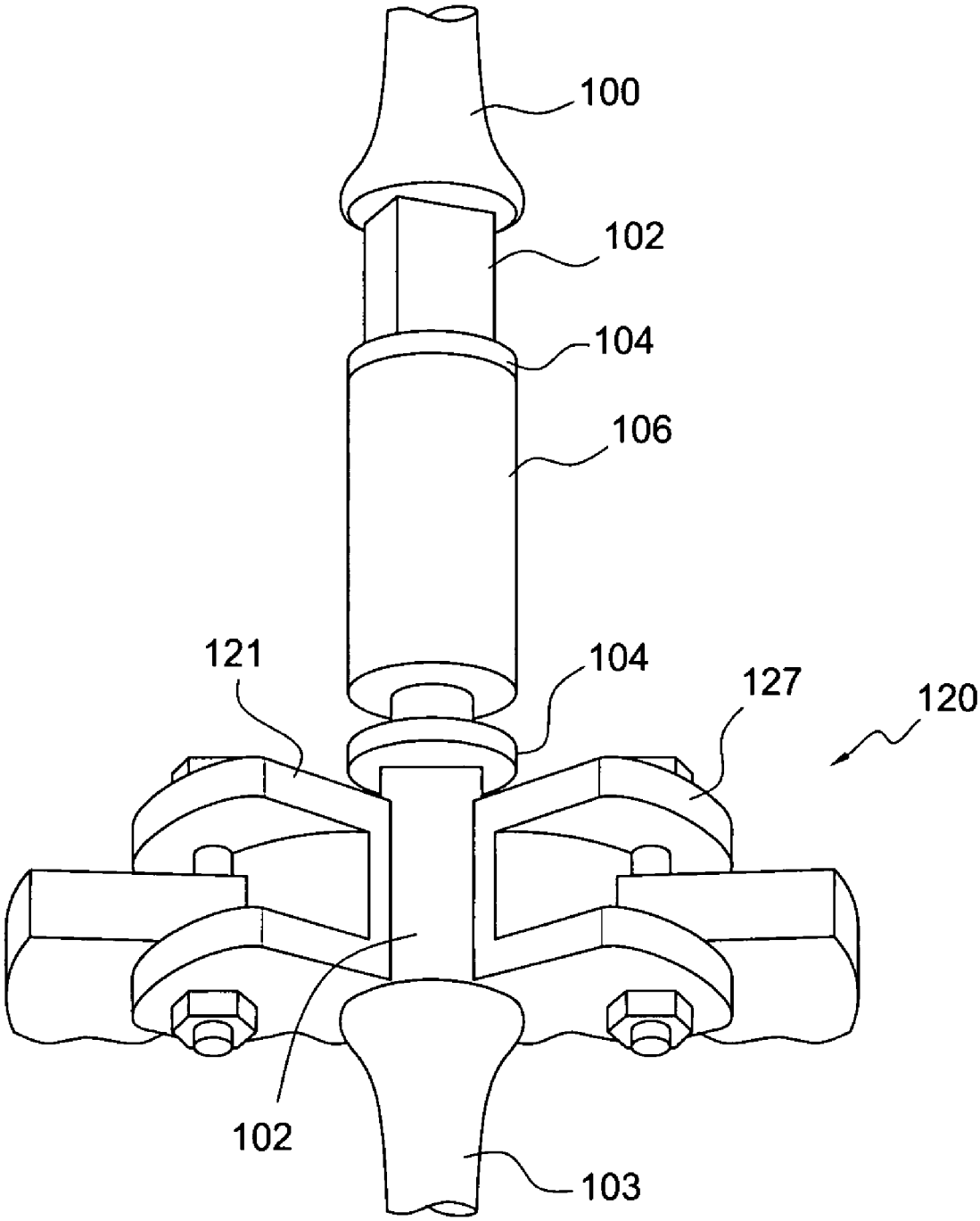
FIG. 7 is a fragmentary view of a backup mechanism used in gripping the sucker rod during make and break operations.
Figure 8:
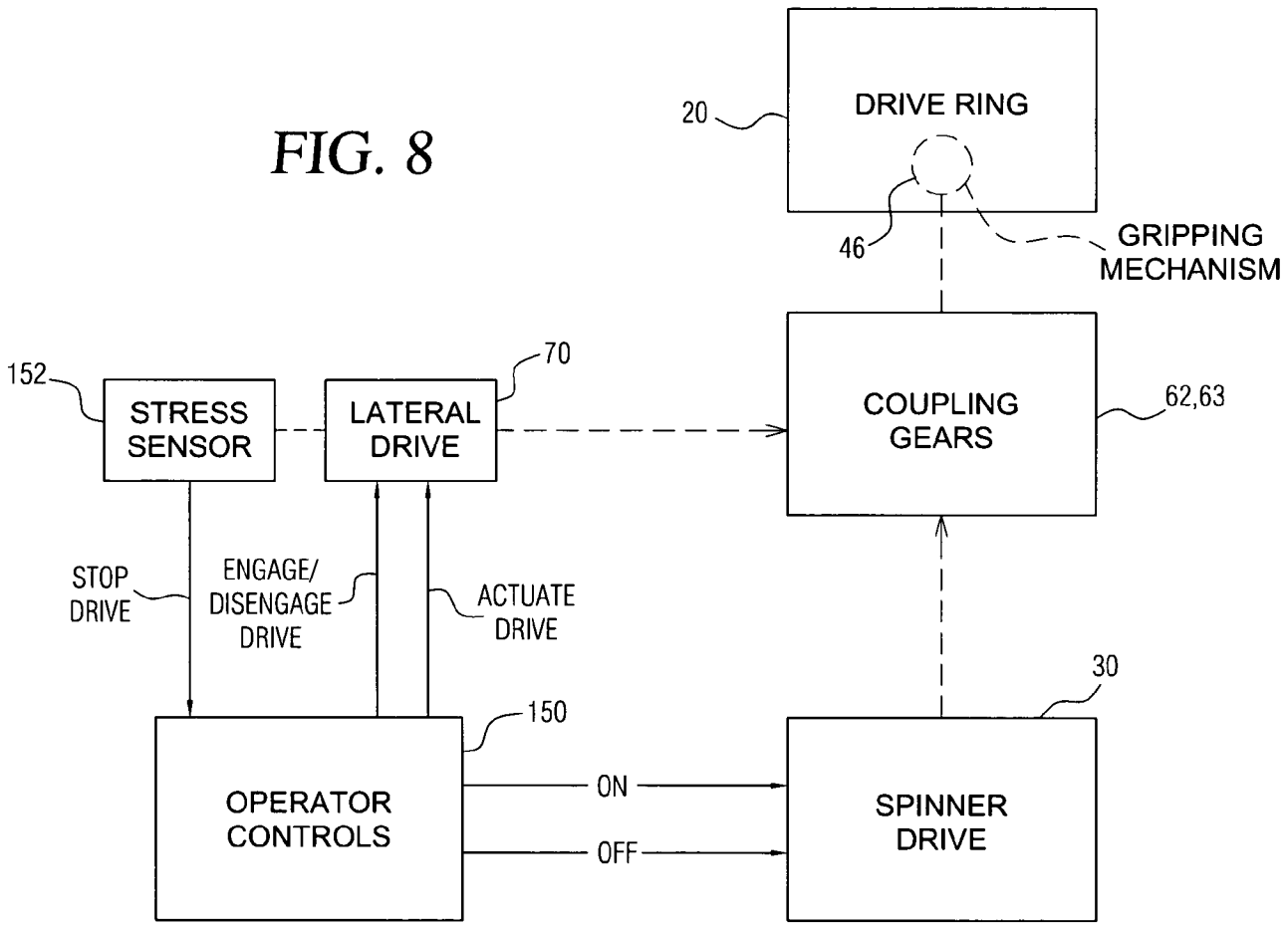
FIG. 8 is a block diagram of the principal elements of a power tong for sucker rod connections in accordance with the invention.

A practical example of a system in accordance with the invention is shown in perspective view in FIG. 6, in fragmentary perspective view in FIG. 7 and with the principal control elements being shown in the block diagram of FIG. 8. The sucker rod 100 extends vertically down through the front section 14 of the housing 10, fitting within the passageway 16 that is provided for access. The sucker rod 100 includes a conventional wrench flat 102 (FIG. 7) and an adjacent extending shoulder 104 with the pin end being threaded into a coupling 106 joined to a second sucker rod 108.

On the power tong assembly (FIG. 6), control hydraulics 110, 112 are shown on opposite sides of the top of the tong housing 10. Details of the valve and interconnections are not shown for simplicity and because numerous conventional hydraulic expedients are available. At one side of the housing is a control lever 114 coupled into the first control unit 110, for activating the spinning mechanism. On the other side of the housing 10 are a pair of control levers 120, 122 engaged to the control hydraulics 112 on that side. These control levers control separate actuation of the spinning drive of the rotary cam gear 20, and also allow separate lateral gear rack operation. Both of these actions are later reversed for disengagement functions.

Handles 125 for manual operation of the tongs are disposed on each side of the housing to enable moving the power tongs, which are separately supported in conventional fashion, into operating position. The assembly, however, can alternatively be operated remotely in a robotic fashion, when assembling a string of sucker rods. In such an automatic operation, successive sucker rods are simply fed through the system, and automatically timed operations are undertaken in sequence, first spinning the sucker rod until shoulder engagement is encountered, then activating the gear rack to provide the selected level of prestress, and operating to disengage the tongs from the connection, so that the string can be advanced to the next connection point where the process is repeated.

Details of the backup mechanism 120 are shown in the fragmentary perspective view of FIG. 7, in which it can be seen that gripper elements 121, 127 are spaced apart to receive opposite sides of a wrench flat 102 for a previously made connection, so that it can be held fixed as the upper sucker rod 100 is spun into position and then prestressed.

The principal elements used in tightening a sucker rod connection to a first stop limit and then to a precise prestress limit are shown in block diagram form on FIG. 8, to which reference is now made. The operator controls 150 are exerted by the levers shown in FIG. 6, and start the spinner drive gear 60, which turns the drive ring 20 through the coupling gears 62, 63 until it reaches a physical stop in the improved Carstensen sucker rod configuration, as encountered. Then the spinner drive gear 60 is stopped, and the lateral gear rack drive 70 is first engaged to the coupling gears 62, 63. Then the lateral gear rack drive 70 is actuated by the operator, linearly moving in to engage the coupling gears 62, 63 and subsequently to turn the drive ring 20 and the connection itself.

The stress sensor 152 is coupled to a support shaft 75 or 75' for lateral gear rack drive 70 to signal that a chosen prestress limit has been reached. As seen in FIG. 9, powering of the lateral gear rack drive 70 in either direction is caused by a concomitant increase in hydraulic pressure, which is sensed with high precision by the transducer 152, so that the drive can stop automatically or under operator control.

Various alternatives will suggest themselves to those skilled in the art, but it is to be understood that the invention encompasses all forms and variations in accordance with the appended claims.

I claim:

1. A system for rotating an elongated element with an end threaded portion into a receiving coupler sleeve with close maintenance of torque applied thereto, comprising:

a drive ring having an open interior about a central axis and peripheral teeth in a plane normal to the axis, an outer bearing surface adjacent the peripheral teeth, and a radial passageway through the ring into the central axis;

a set of support rollers disposed about the periphery of the drive ring and in contrast with the outer bearing surface to maintain the drive ring rotatably concentric with the central axis;

a mechanism disposed in the open interior of the drive ring for gripping an elongated element disposed along the central axis;

an idler gear combination engaging the peripheral teeth on the drive ring;

a rotatable power drive coupled to the idler gear combination for spinning the drive ring, and a linearly movable power drive having a gear rack movable in orthogonal directions to (1) engage the idler gear combination and (2) apply a predetermined force limit to the idler gear combination.

2. A system as set forth in claim 1 above, wherein the system further comprises a housing encompassing the elements, and wherein the housing includes a passageway aligned in at least one position of the drive ring with the radial passageway of the drive ring, and wherein the drive ring includes an interior cam surface and the mechanism for gripping includes cam followers engaging the cam surface.

3. A system as set forth in claim 1 above, wherein the peripheral teeth of the drive ring are at a mid-height region and the outer bearing surface thereof has upper and lower portions and wherein the support rollers have separate surfaces engaging the upper and lower portions of the bearing surfaces of the drive ring.

4. A system as set forth in claim 1 above, wherein the idler gear combination comprises a pair of gears spaced apart about the periphery of the drive ring and each engaging the peripheral teeth thereof and rotatable about axes lying along a predetermined line parallel to a tangent to the drive ring periphery, and wherein the gear rack is disposed parallel to the predetermined line and disposed when unengaged at a selected spacing from idler gears, and wherein the system further includes a drive gear disposed between and engaging both the idler gears.

5. A system as set forth in claim 4 above, wherein the linearly movable power drive includes a frame reciprocable along an axis parallel to the predetermined line and wherein the system further includes a double acting cylinder resting on end shafts lying parallel to the predetermined line in the frame.

6. A torquing system for tightening a sucker rod connection to a selected limit past a stop position, comprising:

a ring drive system including an interior mechanism for engaging the sucker rod;

a peripheral drive rotatably engaging the ring drive;

a hydraulically powered rotary drive operatively connected to the peripheral drive for tightening the connection to a stop position;

a lateral drive mechanism initially positioned at a radial spacing from the peripheral drive in a first mode of operation;

a radial shifter mechanism coupled to the lateral drive mechanism and engaging the lateral drive mechanism to the peripheral drive in a second mode of operation, and a power drive coupled to the lateral drive mechanism for moving the ring drive system through the peripheral drive to tighten the connection to a limit position in the second mode of operation.

7. A system as set forth in claim 6 above, further including a control which includes a stress sensor responsive to the force applied to the connection by the lateral drive mechanism to terminate the tightening of the connection at a selectable stress level.

8. A power ring system for makeup of a sucker rod connection requiring a precise maximum level of prestress torque, comprising:

a rotary mechanism having exterior peripheral drive teeth and including a radial passageway for accessing wrench flat surfaces of a sucker rod positioned along a central axis therein, the rotary mechanism including an interior wrench flat gripping mechanism radially movable relative to the central axis;

a gear drive disposed adjacent and in engagement with the peripheral drive teeth of the rotary mechanism;

a spinner drive mechanism including an actuable motor and a power drive gear engaging the gear drive;

a lateral drive mechanism nominally spaced from the gear drive by a selected radial distance, the lateral drive mechanism including a first radial shifter for engaging the lateral drive mechanism to the gear drive, and a second, reciprocating shifter coupled to the lateral drive mechanism and movable thereby, for rotating the gear drive and the rotary mechanism.

9. A system as set forth in claim 8 above, wherein the lateral drive mechanism further comprises a stress sensitive sensor connected to the lateral drive mechanism, and responsive to the force exerted by the lateral drive mechanism, and a hydraulic driver coupled to the second reciprocating shifter, wherein the hydraulic driver operation is responsive to the stress sensitive sensor to terminate force application at a selected stress limit.

10. A system as set forth in claim 8 above, wherein the gear drive comprises a pair of idler gears and wherein the lateral drive mechanism comprises a rack gear orthogonally movable with respect to the idler gears.

11. A torquing system for precisely making up threaded connections between elongated elements in oil field applications to secure male-female connections into a series for downhole installations, comprising:

a gripper head device disposed to be radially movable relative to a predetermined axis of rotation, the gripper head lying in a reference plane normal to the predetermined axis, and including cam follower means movable radially relative to the axis;

a rotary drive ring disposed about the predetermined axis in the reference plane and including peripheral teeth and an interior cam surface engaging the cam follower means, such that the gripper head device is engaged against an elongated element lying along the predetermined axis at least one rotational position of the rotary drive;

an idler gear assembly positioned in operative engagement with the peripheral teeth of the rotary drive at a drive side thereof;

a rotary drive mechanism coupled to the idler gear assembly for selectively rotating the rotary drive ring;

a longitudinal drive mechanism including a drive rack disposed adjacent and proximate to a tangent to the idler gear assembly, the longitudinal drive mechanism being movable in a first direction to engage the idler gear assembly and in a second, perpendicular direction to rotate the idler gear assembly;

first actuator engaged to the longitudinal drive assembly for selectively shifting said assembly in the first direction into engagement with the idler gear assembly, and a second actuator engaged to the longitudinal drive assembly for selectively driving the idler gear assembly and rotary drive to a selected torque limit.

12. A system as set forth in claim 11 above, further comprising a body structure encompassing the components of the system, and further including a number of engagement rollers mounted in the body and disposed about the periphery of the rotary drive ring for maintaining the drive ring position during the application of loading forces, and wherein both the drive ring and the body structure include an entry passageway of at least an adequate width to receive the elongated elements at the predetermined axis from outside the body.

13. A system as set forth in claim 12 above, wherein the interior cam surface of the rotary drive ring is contoured to engage the gripper head device against the elongated element such that the rotary drive ring thereafter rotates the elongated element to a stop position, and wherein the longitudinal drive mechanism thereafter adds torsional force to a final predetermined torque limit.

14. A system as set forth in claim 13 above, wherein the longitudinal drive mechanism comprises a frame base movable orthogonally in the body structure, the drive rack being mounted and movable on one side of the frame base, wherein the first actuator is coupled to the body structure and said drive mechanism and is hydraulically operated and where the second actuator comprises a hydraulically driven piston.

15. A power tong system for precisely torquing elongated elements having wrench flat surfaces that are to be threaded together in end to end male-female relation with predetermined torque after a geometry defined stop position is reached, comprising the combination of:

a body structure having a front section and a rear section and including a passageway for receiving the lengths of elongated elements in vertical position along a rotational axis, perpendicular to a horizontal reference plane;

a drive ring mounted in the front section above the rotational axis and including a radial passageway to the axis, the drive ring including peripheral drive teeth;

an array of rollers mounted in the body structure about the periphery of the drive ring and in contact with the ring periphery separate from the drive teeth;

at least one idler gear mounted in the body structure or contact with the drive ring teeth in a position between the front and rear sections and engaging the peripheral drive teeth on the ring;

a rotary drive including a drive gear coupled to the at least one idler gear for spinning the elongated element to make up the connection to the geometrical defined stop position, and a longitudinal drive combination including a drive rack selectably engageable to the drive gear for applying a predetermined amount of additional torque to the connection after the stop position is reached.

16. A system as set forth in claim 15 above, wherein the longitudinal drive combination includes a drive rack support that is movable orthogonally into contact with the drive gear and laterally to rotate the drive gear and drive ring until torque to a predetermined limit is applied to the connection.

17. A system as set forth in claim 16 above, wherein the system includes an engagement mechanism activated by the drive ring for closing onto the wrench flat surfaces to enable rotation of the elongated elements with the drive ring.

18. A system as set forth in claim 17 above, wherein the longitudinal drive combination includes orthogonally operable hydraulic actuators coupled to the drive rack support and mounted on the body structure.

19. A system as set forth in claim 17 above, wherein the engagement mechanism includes wrench flat engagement means radially movable with respect to and adjacent to the rotational axis and including cam followers, and wherein the drive ring has an internal cam surface in contact with the cam followers, shaped to force the engagement mechanisms against the wrench flat.

20. A system as set forth in claim 15 above, wherein the elongated elements are sucker rods interconnected by coupling including interior facing surfaces to be compressively prestressed to a selected level, and wherein the system includes a backup mechanism for securing a prior connection in the string as a pair of elements are threaded together to a chosen torque level.

* * * * *